US005431038A

United States Patent [19]

Cheers et al.

[11] Patent Number: 5,431,038

[45] Date of Patent: Jul. 11, 1995

[54] APPARATUS FOR FEEDING A WORKPIECE TO A TOOL

[75] Inventors: Christopher F. Cheers, Swindon; Paul Porucznik, Oxfordshire, both of England

[73] Assignee: Carnaudmetalbox plc, England

[21] Appl. No.: 228,271

[22] Filed: Apr. 15, 1994

[30] Foreign Application Priority Data

Apr. 24, 1993 [GB] United Kingdom ..... 9308532

[51] Int. Cl.[6] ..... B21D 24/16

[52] U.S. Cl. ..... 72/361; 72/420

[58] Field of Search ..... 72/349, 361, 420, 424, 72/428, 425; 413/47, 48, 49, 50, 51

[56] References Cited

U.S. PATENT DOCUMENTS 1,733,445 10/1929 Burns ..... 72/361

3,378,129 4/1968 Mencacci .

4,061,012 12/1977 Wessman .

FOREIGN PATENT DOCUMENTS 049923 10/1981 European Pat. Off. .

373845 12/1989 European Pat. Off. .

769154 2/1934 France .

3510193 3/1985 Germany .

*Primary Examiner*—Lowell A. Larson

*Attorney, Agent, or Firm*—Diller, Ramik & Wight

[57] ABSTRACT

In a press feed of the kind comprising an upright chute 1, a rotatable feed cam 2 adjacent the chute and guide rails 3,4 around the feed cam to guide a workpiece or cup 5 to a cup holding stop member 7 between a punch 10 and die 9, a clamp member 6 engages the cup as it leaves the feed cam to push the cup into the stop member and hold it until the punch 10 and blank holder 8 have entered the cup.

19 Claims, 6 Drawing Sheets

APPARATUS FOR FEEDING A WORKPIECE TO A TOOL

BACKGROUND OF THE INVENTION

This invention relates to apparatus for taking a workpiece from a procession of workpieces and locating it at a tool, and more particularly, but not exclusively, to apparatus for removing a cup from a chute to a locating means in a press tool comprising a punch and die.

European Patent 0049923 B1 describes apparatus in which a procession of cups fall down a chute from which the leading cup is removed by a generally radial portion of a spiral cam disc. The spiral cam disc drives each cup along an arcuate guide rail which extends to a tangential guide rail portion. This tangential guide rail portion leads to a stop member which holds the cup in the desired location while the cam rotates to collect another cup. The spiral portion of the cam surface serves continuously to control descent of each cup from the chute but, recognising that a complete spiral periphery would leave a cup at the stop member free to bounce or spring out of correct location, the cam profile has an arcuate portion between the generally radial portion and spiral. This arcuate portion serves to provide a temporary holding force on a cup at the stop member. However, the presence of this arcuate portion of cam profile reduces the extent of the spiral portion of the cam profile and so introduces problems:

(i) the rate of descent of cups from the chute is temporarily stopped by the arcuate portion so that inertia forces develop in the intermittently advancing cups;

(ii) the peripheral extent of arcuate portion and speed of rotation of the cam disc limit the period of holding available; and (iii) as improved presses are developed to run at higher speeds of about 350 strokes per minute we have found that an improvement in the delivery and holding at the stop member is required.

SUMMARY OF THE INVENTION

Accordingly this invention provides apparatus for taking a workpiece from a procession of workpieces and locating it in a stationary stop member, said apparatus comprising:

a feed chute for feeding a procession of workpieces;

a rotatable feed cam adjacent the chute and having a cam profile which includes a spiral portion around the axis of rotation of the cam to lower a workpiece from the chute and drive the workpiece towards the stop member;

an outer guide member having a spiral curved portion which extends around the axis of rotation of the feed cam and a further guide portion extending in a direction susbtantially tangential to the curved portion;

and a stationary stop member adapted to receive the workpiece from the further guide portion, characterised in that, a clamp member is operably connected to the feed cam to move from a retracted position to engage with a workpiece received from the feed cam and urge the workpiece along said further guide portion into the stationary stop member where it is clamped.

This invention is particularly useful for removing cups, having a cylindrical side wall, from a chute and locating each cup in the stop member in accurate alignment with a punch and die.

Preferably, the guide member comprises an outer guide rail having a spiral guide surface leading to a straight guide surface, and an inner guide rail having complimentary guide surfaces to urge the workpieces or articles away from the axis of rotation of the feed cam, so each article is freed from the thrust surface of the feed cam as the clamp member makes contact to take control.

The clamp member may conveniently be moved by a clamp control cam. In a preferred embodiment the clamp member is in the form of a lever having a portion adapted to engage the article to one side of a pivot and a lever portion to the other side of the pivot. The lever may have a rotatable follower to follow the profile of the control cam.

Preferably, the cam follower is urged to follow the control cam profile by resilient means, such as a pneumatic cylinder having a rod which is coupled to the lever portion of the clamp member to pull on the lever. However, an operable arrangement may be achieved by other resilient means such as a compressed spring or a spring in tension.

In a preferred embodiment the feed cam and clamp control cam are mounted for rotation about a common axis.

In one embodiment the article receiving surface of the stop member has means to maintain a fluid cushion therein.

If desired, the feed cam may be driven to rotate by a driving mechanism, operably connected between a motor and the feed cam, to cause the feed cam to rotate at accelerating speed between the chute and the stop member so contact with the feed cam is maintained.

In one embodiment the driving mechanism comprises a driven member having a radial slot which rotates about a first axis, and a driving member rotatable about a second axis parallel to but spaced apart from said first axis, and a crank pin of the driving member engaged in the slot of the driven member. This driving mechanism may be in a separate box or alternatively may be mounted on the fixed axle on which the feed cam rotates: however the axle would need to have stepped surfaces to provide the two axes of rotation.

Benefits arising from the apparatus are:

(1) The article is under positive control forces at all times during transport from the chute to the stop member so that continuous motion of each article is achieved and stop/start forces are avoided.

(2) Separation of the transport function of the feed cam from the prior art holding function, by provision of a separate holding means, increase the ability of our apparatus to tolerate minor variation of article shape such as cups which are not quite circular.

(3) The positive control forces provided enable this apparatus to feed press tools stroking at rates in excess of 300 stokes per minute, because risk of distortion of the cup is reduced.

Various embodiments will now be described by way of example and reference to the accompanying drawings in which:

DESCRIPTION OF THE PREFERRED EMBODIMENTS

Figure 1:
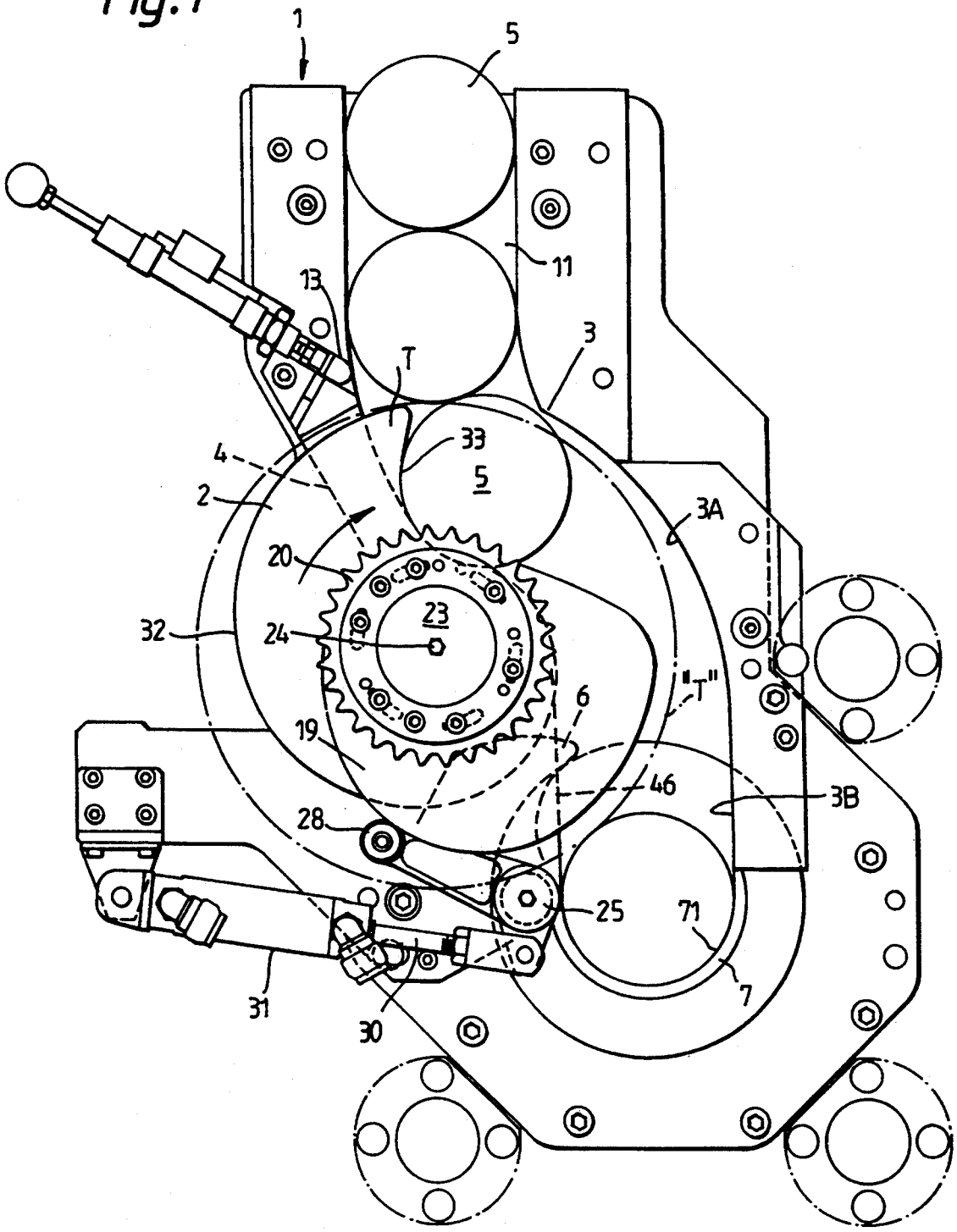
FIG. 1 is a schematic view of apparatus at a time when generally radial portion of the cam profile starts to move a cup.
Figure 4:
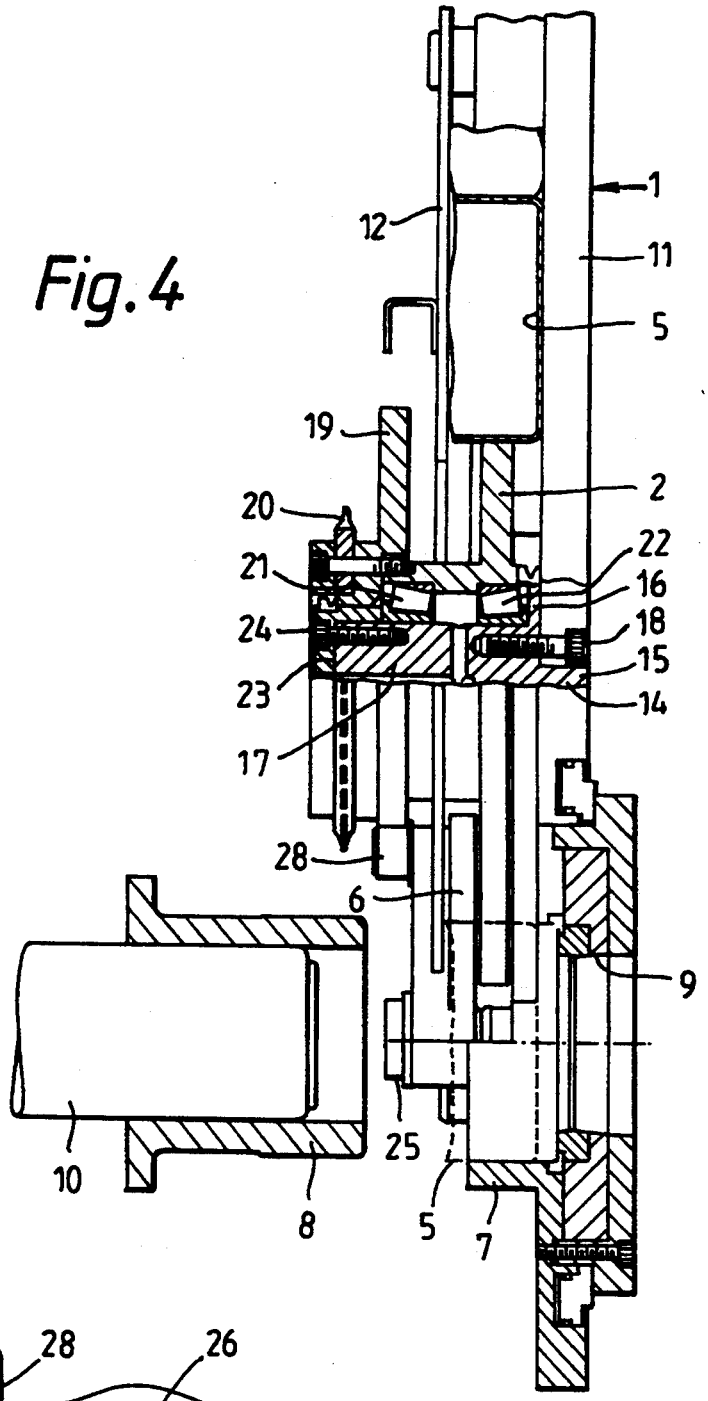
FIG. 4 is a part sectioned side view of the apparatus of FIG. 1 and a cup held in the stop member.

FIGS. 1 and 4 show apparatus comprising a feed chute 1, a rotatable feed cam 2, adjacent the chute, an outer guide rail 3 extending around the feed cam, an inner guide rail 4 defining with the outer guide rail 3 a path for a cup 5 driven along it by the feed cam, a clamp member 6, and a stop member 7. The clamp member is movable to hold the cup 5 at the stop member 7 in correct alignment with a blank holder 8, a die 9 and punch 10.

The feed chute comprises a first plate 11, a second plate 12, an outer guide rail portion 3A and an inner guide rail portion 4A so that each cylindrical cup 5 falls down the chute with its bottom wall against the first plate 11. During setting of the punch, blank holder and die it is convenient to prevent cups falling from the chute so a manually, or pneumatically operated member 13 may be provided, as shown in a retracted postion in FIG. 1, to pass under the cups in the stack to stop the cups passing from the chute.

The first plate 11 supports a fixed axle 14 best seen in FIG. 4. The axle 14 comprises a centering portion 15 entered in the plate 11, a flange portion 16,, and a bearing portion 17, and is fixed to the plate 11 by studs 18. The feed cam 2, a clamp control cam 19 and a drive sprocket 20 are fixed together by studs and mounted on a pair of opposed taper roller bearing 21,22 supported by the axle 14. The bearings 21,22 are held on the axle by a plate 23 fixed to the axle by a nut 24. The first plate 11 supports the stop member 7 in alignment with the feed chute 1, the die 9, and the blank holder 8. The stop member has an arcuate surface 71 to receive the cylindrical wall of each cup.

Figure 5:
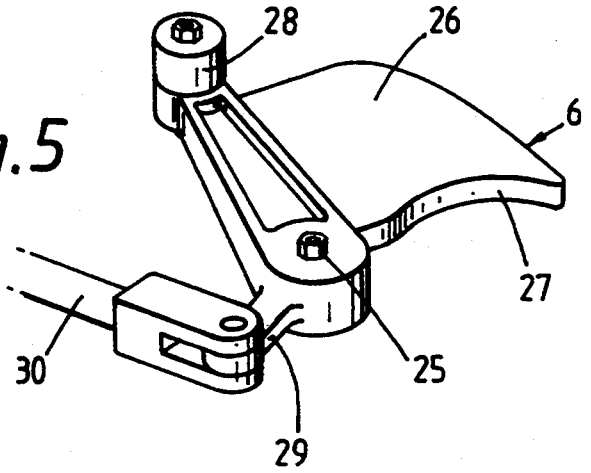
FIG. 5 is perspective sketch of the clamp member.

The first plate 11 also supports the clamp member pivotally on a pivot 25. As shown in FIG. 5, the clamp member has a planar portion 26 provided with an arcuate surface 27 to engage the side wall of a cup, a rotatable follower 28 upstanding from the planar portion to engage the clamp control cam 19, and a lever portion 29 extending from the planar portion 26 for connection to a rod 30 of a pneumatic cylinder 31 (shown in FIG. 1) fixed to the first plate 11. The pneumatic cylinder 31 serves to resiliently urge the follower to follow the profile of the clamp control cam. Whilst other resilient means, such as a spring might be used to urge the follower to engage the clamp control cam, this pneumatic cylinder gives satisfactory compliance at feed speeds of over 350 cups per minute. The use of an air cylinder, deactivated by abatement of air pressure, renders the apparatus safe for adjustment.

The feed cam 2 has a profile comprising a spiral portion subtending substantially 360° at the axis of rotation and an arcuate thrust surface extending in a generally radial direction from low to high point or tip T of the spiral portion. Therefore a cup from the delivery chute is continuously lowered by the feed cam rotation until the generally radial thrust surface sweeps the cup away from the chute, as shown in FIG. 1, to travel between the inner guide 4 and outer guide 3.

The circular trajectory of the tip T or highest point of the feed cam profile is shown by a dashed circle denoted "T" in FIG. 1 and it will be noticed that the outer guide surface swings away from this circular trajectory to a straight portion which leads to the stop member 7. The inner guide rail 4 has a guide surface complementary to the guide surface of the outer guide rail to define a path of width equal to the cups. As the cup is advanced between the inner and outer straight guide surfaces 4B and 3B the cup is guided away from the axle and out of engagement with the arcuate thrust surface 33 of the feed cam. It is preferable that there by clearance between the cup and curved guide portions but at the straight guide surfaces the clearances gradually reduces to zero at the stop member.

Figure 2:
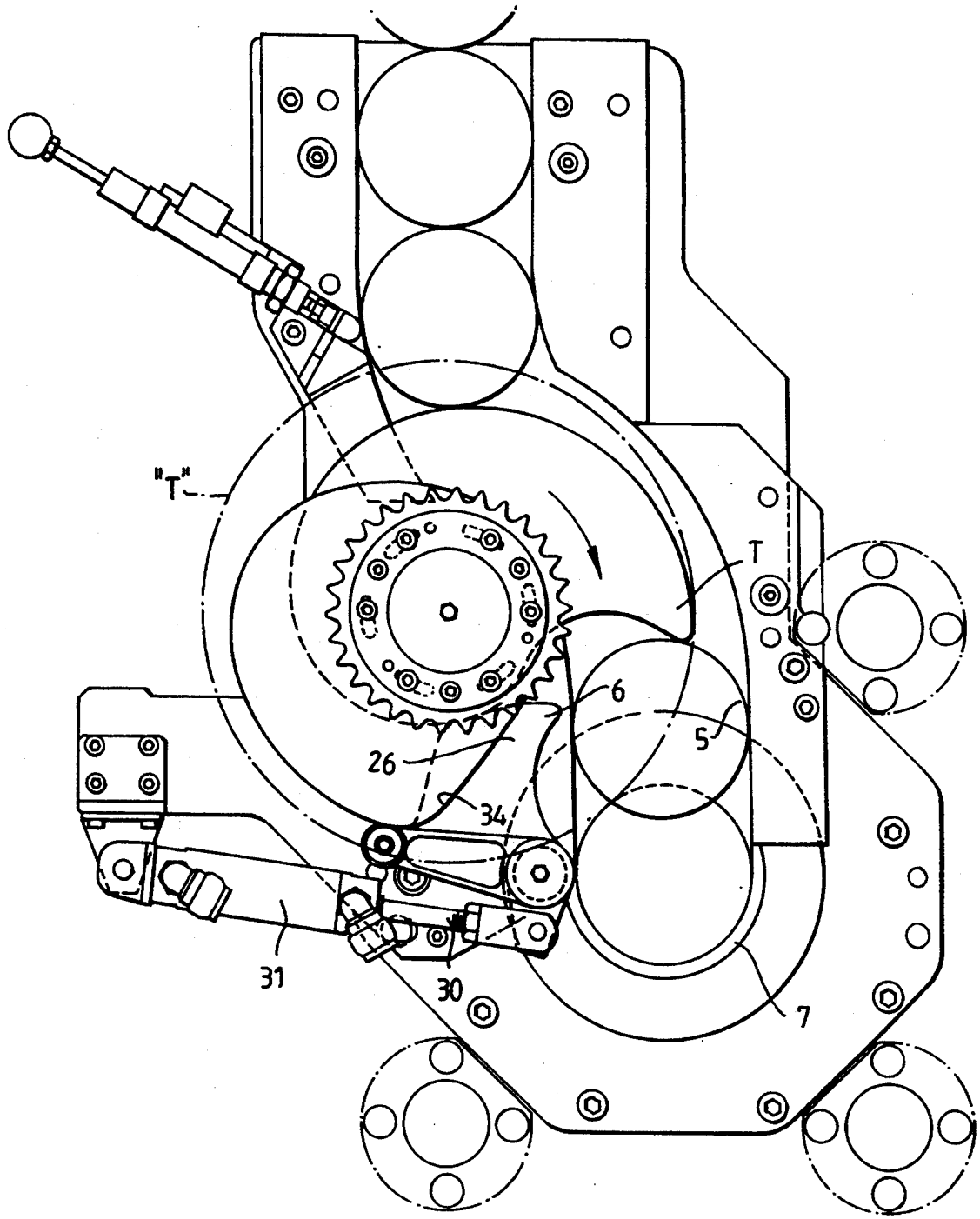
FIG. 2 is a like view of the apparatus of FIG. 1 at a time when cup reaches the clamp member.

FIG. 2 shows a cup 5 about to leave the thrust surface of the feed cam and receive a force from the clamp member as the clamp member follower is urged onto declining portion 34 of the clamp control cam profile. As the clamp 6 contacts the cup 5, the cup is urged to travel along the straight portions 3B, 4B of the outer and inner guides into the cup locating stop member.

Figure 3:
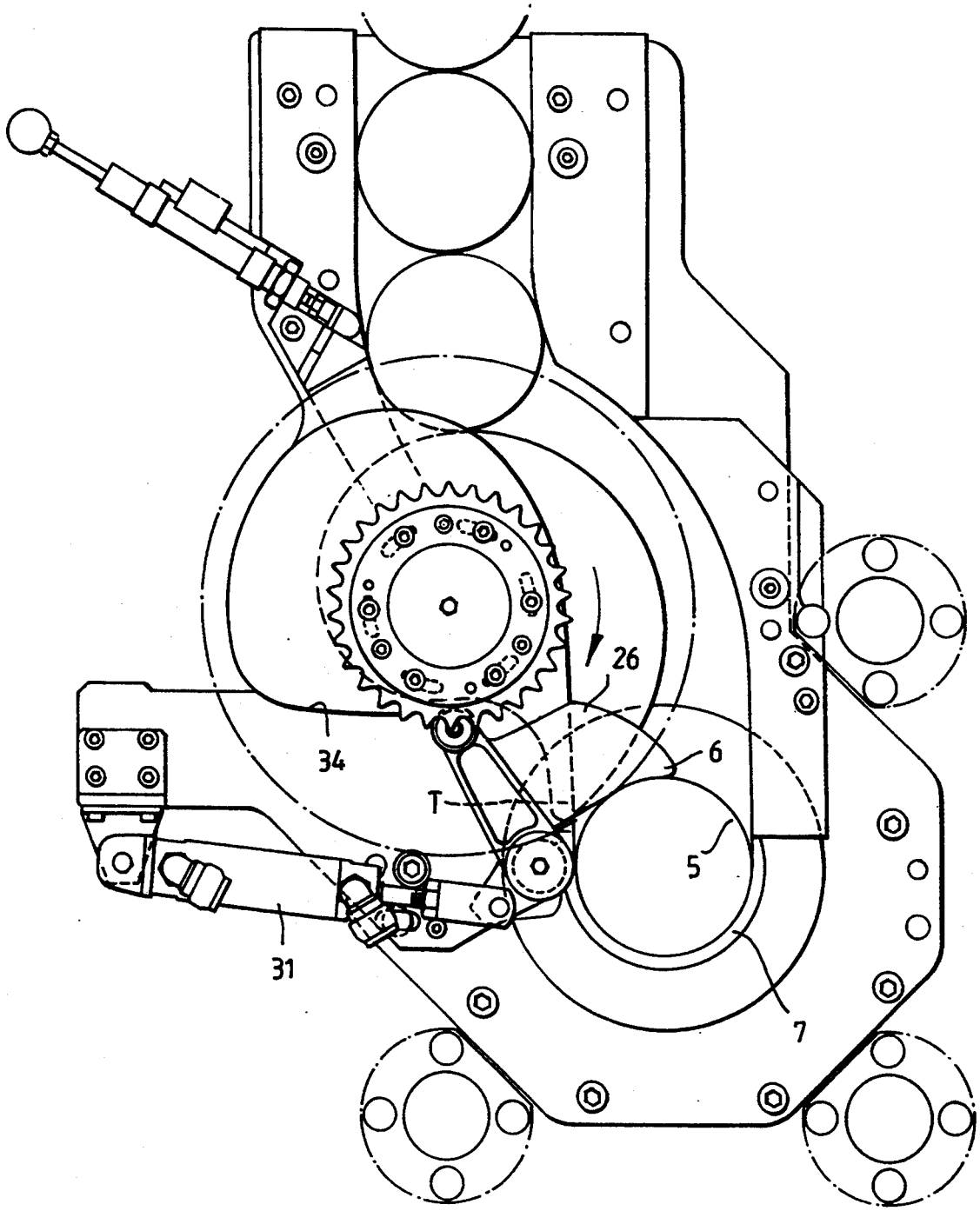
FIG. 3 is a like view of the apparatus of FIG. 1 at a time when the clamp member holds the cup against the stop member.

FIG. 3 shows a cup when clamped in the stop member 7 by the clamp member 6. The tip T of the feed cam has rotated past the cup so that the cup is held in the stop member only by the clamp member in correct location for approach of the punch 10 and blank holder 8 shown in FIG. 4.

An arcuate portion of the clamp control cam ensures that the clamp member holds the cup 5 in the stop member 7 until the blank holder 8 and punch 10 have entered the cup. Thereafter continuing rotation of the clamp control cam retracts the clamp member from the holding position while the feed cam collects another cup.

Figure 6:
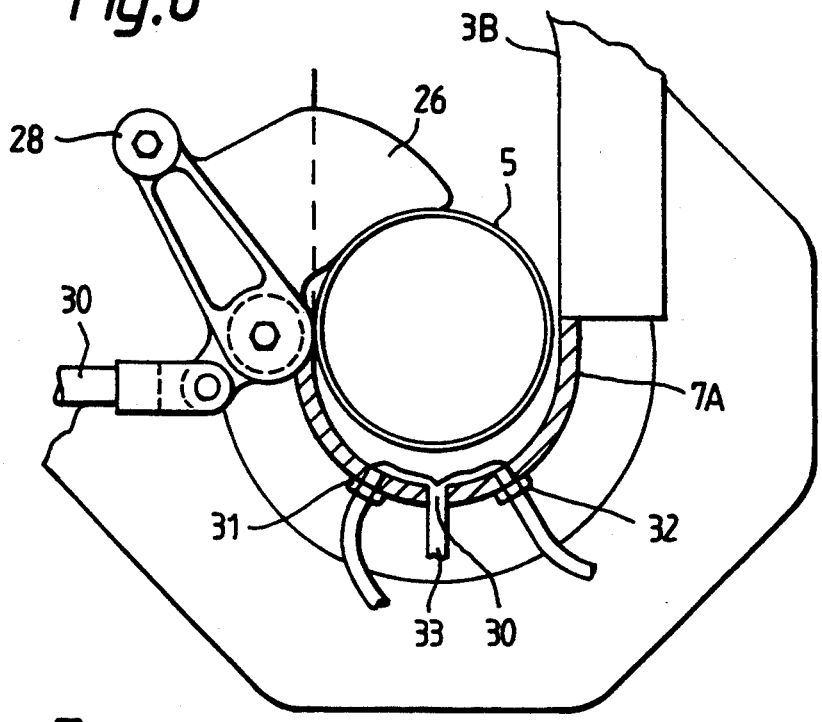
FIG. 6 is a part sectioned view of a modified stop member having passageways for fluid.

FIG. 6 shows a modified form of stop member 7A provided with a drain hole 30 at the lowest point on the arcuate surface of the stop member and feed holes 31, 32 to each side of the drain hole. A fluid 33 is fed to the feed holes at low pressure and flows down the arcuate surface to pass out of the drain hole, so presenting a fluid cushion on which the advancing cup 5 comes to rest. Typically the fluid is an emulsion of oil in water such as is used to lubricate the punch and dies of a wall ironing machine. If desired, suction may be applied to the drain hole or other locations around the stop member to control the volume of fluid under the cup and prevent disturbance of the cup which could be caused by excessive fluid in the stop member. In an alternative arrangement coolant fluid from the tool pack flows across the stop member to provide a cushion.

Figure 7:
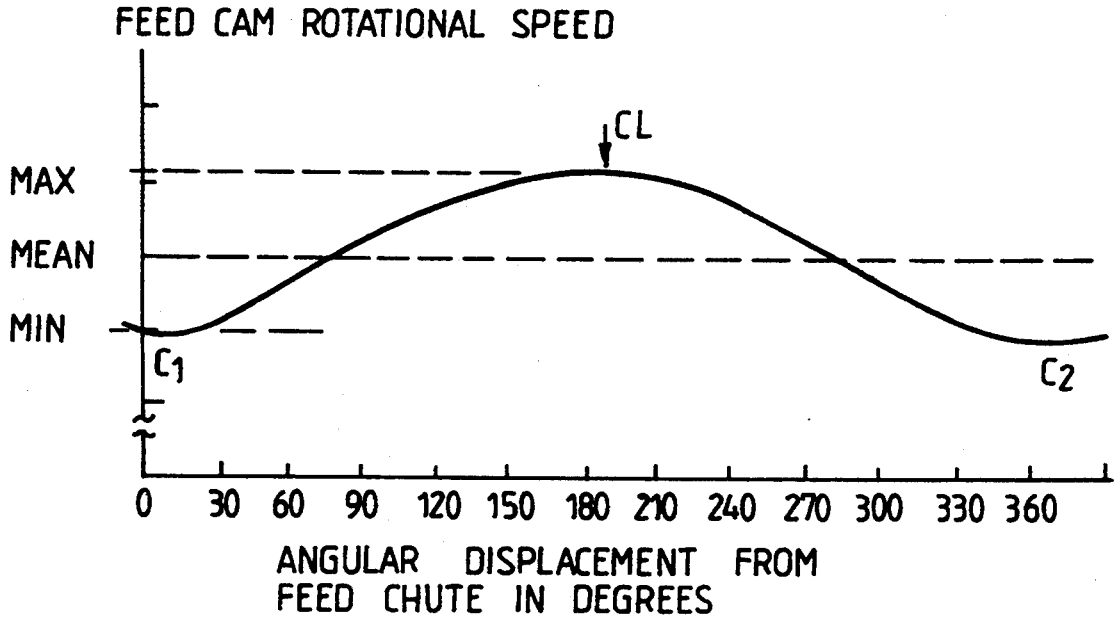
FIG. 7 is a graph of feed cam rotational speed v angular displacement of the feed cam from the chute.

FIG. 7 shows a variable angular velocity profile which may optionally be implemented in the drive mechanism which rotates the feed cam. This shows the angular velocity of the feed cam varying continuously over each revolution. In this case, the maximum velocity is 20 per cent higher than the average velocity and the minimum velocity is 20 per cent lower than the average velocity, and profile of the variation about the average value is substantially sinusoidal.

Figure 8:
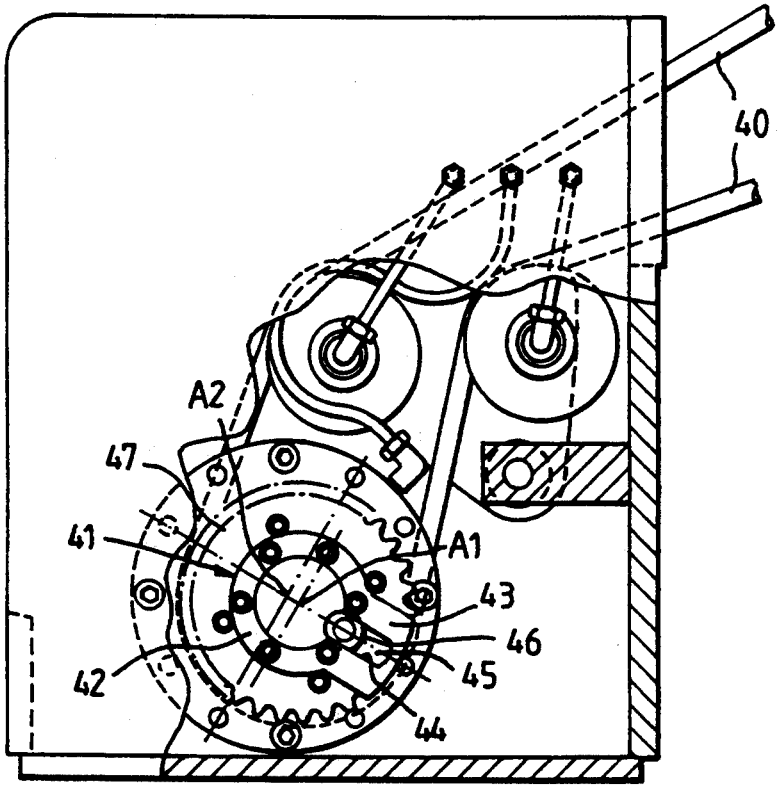
FIG. 8 is an end view of a drive mechanism sectioned on line VIII—VIII in FIG. 9.
Figure 9:
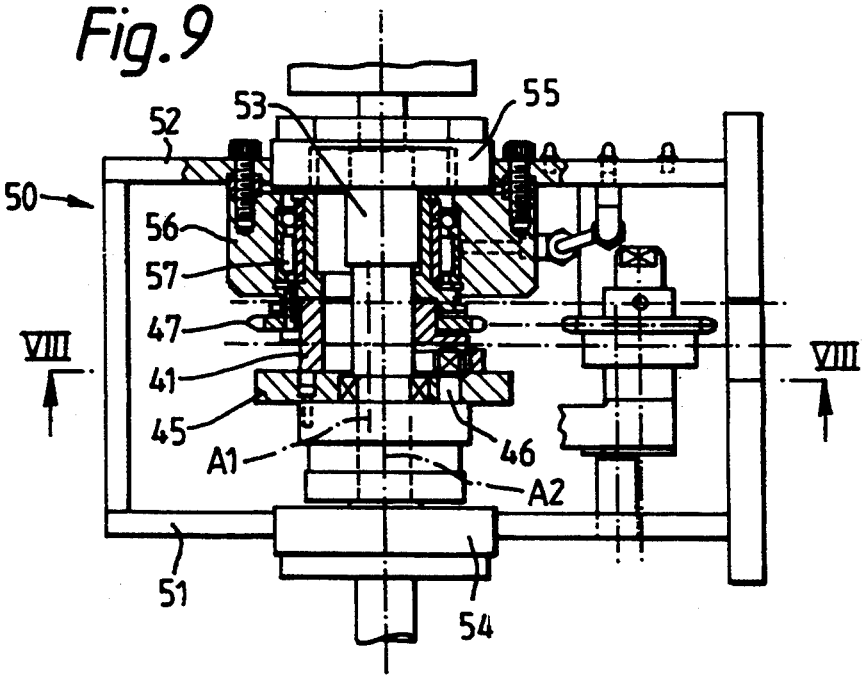
FIG. 9 is a side view of the mechanism of FIG. 8 locally cut away to show the drive mechanism.

By way of example, FIGS. 8 and 9 show one form of drive mechanism adapted to receive a steady speed of drive and convert the drive speed to an accelerating and decelerating cycle which is passed via a drive chain 40 to the sprocket 20 shown in FIGS. 1 to 3.

FIG. 8 shows a driven member 41 comprising a circular annulus 42 with a lug 43 extending laterally from the annulus to define a slot 44 which extends in a radial direction away from the centre of the annulus. The driven member is mounted for rotation about a first axis A1.

A driving member 45, visible in FIG. 8 through the driven member, comprises a circular disc with a crank pin 46 rooted in it an upstanding to operably engage with the slot 44 of the driven member 41. Preferably a square bush surrounds pin 46 to minimise wear of the slot. The driving member 45 is mounted for rotation about a second axis A2 parallel, but distant from the axis A1. Choice of this distance apart of axes A1, A2 and the radial distance of crank pin 46 from axis A2 governs the amplitude of the variation in delivered speed.

Rotation of the driving member 45 causes the driven member to rotate but, as the driving member rotates the pin/bush 46 move relative to the slot 44 to act at a continuously varying radius on the driven member so that the arc of rotation swept by the driven sprocket 47, fixed to the driven member by studs, varies accordingly and is passed to the feeder sprocket 7 by the chain 40.

FIG. 9 shows that the drive mechanism comprises a box 50 having opposed walls 51, 52. The driving member is mounted on a shaft 53 supported by bearings 54, 55 in walls 51, 52 respectively.

The driven member 41 and sprocket 47 are fixed together on a hub for rotation in roller bearing 57 supported in a substantial annulus bearing housing 56.

Alternative methods of producing the same type of motion are available, eg, using a proprietary harmonic drive box containing paradromic cams and followers to define the motion profile. Such drive boxes are available from various suppliers including Camco and Colombo Fillipetti.

To benefit from this type of motion, the low speed part of the cycle should correspond to the position of the feed cam shown in position shown in FIG. 3. The motion profile described is suitable when these positions are approximately 180° apart (say between 160° and 200°). If an angular separation outside this range is required, then the motion profile could be modified to match. There are three advantages arising from the use of this varying velocity profile:

1) The impact of the feed cam against the lowest cup in the delivery chute (feed cam in position of FIG. 1) is reduced because the angular velocity here is less than the average velocity.
2) The control of the cup is improved while being swept around the path defined by the outer and inner guide rails (feed cam position in the range between FIG. 1 and FIG. 3, eg. at position shown in FIG. 2). This is because the increasing angular velocity of the feed cam causes a corresponding increase in the tangential component of the velocity of the cup 9, ie. an increase in the tangential acceleration. This implies an increase in the tangential force applied by the cup feed cam to the cup, and this increases the likelihood of the cup staying in contact with the feed cam and remaining under full control during the feed process.
3) The time taken for the cup to move from the position shown in FIG. 2 to that shown in FIG. 3 is reduced because during this part of the revolution the angular velocity of the feed cam is nearing its maximum value. This is important, because the other movements of the machine must be timed to prevent unwanted contact between the cup and tools. When the cup reaches the position shown in FIG. 2, the punch 10 must have withdrawn far enough to allow the cup to pass in front of it. Also, the cup must reach the position shown in FIG. 3 before the blankholder 8 begins to enter it, and the blankholder 8 must clamp the cup against the redraw die 9 before the punch 10 begins the redraw. These three facts define the machine timing. Reducing the time taken for the cup to move between these two positions permits the use of a shorter stroke machine, and this has various advantages such as reduced shaking forces, reduced bearing loads and the option to run the machine at higher speed.

Although a preferred embodiment of the invention has been specifically illustrated and described herein, it is to be understood that minor variations may be made in the apparatus without departing from the spirit and scope of the invention, as defined the appended claims.

We claim:

1. Apparatus for taking a workpiece from a procession of workpieces and locating it in a stationary stop member, said apparatus comprising:

a feed chute for feeding a procession of workpieces;

a rotatable feed cam adjacent the chute and having a cam profile which includes a spiral portion around the axis of rotation of the cam to lower a workpiece from the chute and drive the workpiece towards the stop member;

an outer guide member having a spiral curved portion which extends around the axis of rotation of the feed cam and a further guide portion extending in a direction substantially tangential to the curved portion;

and a stationary stop member adapted to receive the workpiece from the further guide portion, characterised in that, a clamp member is operably connected to the feed cam to move from a retracted position to engage with a workpiece along said further guide portion into the stationary stop member where it is clamped.

2. Apparatus according to claim 1 wherein the guide member comprises an outer guide having a spiral guide surface leading to said straight guide surface and an inner guide rail having complementary surfaces to urge the workpiece from the axis of rotation of the feed cam into the stop member.

3. Apparatus according to claim 2 wherein the clamp member is moved towards the holding position by a control cam.

4. Apparatus according to claim 1 wherein the clamp member is moved towards the holding position by a control cam.

5. Apparatus according to claim 4 wherein the clamp member comprises a portion adpated to engage with the workpiece, a lever portion operably connected to means to resiliently urge the clamp member against the control cam and a pivot between said lever portion and the workpiece engaging portion.

6. Apparatus according to claim 5 wherein the clamp member has a rotatable follower to follow the control cam profile.

7. Apparatus according to claim 5 wherein the clamp member is urged to cooperate with the control cam profile by resilient means.

8. Apparatus according to claim 5 wherein the control cam and feed cam are mounted for rotation about a common axis.

9. Apparatus according to claim 4 wherein the clamp member has a rotatable follower to follow the control cam profile.

10. Apparatus according to claim 9 wherein the clamp member is urged to cooperate with the control cam profile by resilient means.

11. Apparatus according to claim 4 wherein the control cam and feed cam are mounted for rotation about a common axis.

12. Apparatus according to claim 4 wherein the clamp member is urged to cooperate with the control cam profile by resilient means.

13. Apparatus according to claim 12 wherein the control cam and feed cam are mounted for rotation about a common axis.

14. Apparatus according to claim 12 wherein the resilient means is an air cylinder.

15. Apparatus according to claim 14 wherein the control cam and feed cam are mounted for rotation about a common axis.

16. Apparatus according to claim 4 wherein the control cam and feed cam are mounted for rotation about a common axis.

17. Apparatus according to claim 1 wherein the workpiece receiving surface of the stop member has means to maintain a fluid cushion thereon.

18. Apparatus according to claim 1 wherein a driving mechanism, operably connected between a motor and the feed cam, causes the feed cam to rotate at accelerating speed between the chute and clamp member.

19. Apparatus according to claim 18 wherein the driving mechanism includes a driven member having a radial slot which rotates about a first axis, a driving member rotatable about a second axis parallel to but spaced from said first axis and a crank pin on the driving member engaged in the slot of the driven member.

* * * * *